US010208493B1

(12) United States Patent
Sim

(10) Patent No.: US 10,208,493 B1
(45) Date of Patent: Feb. 19, 2019

(54) COLUMN REINFORCING STRUCTURE USING V-SHAPED TIE BARS

(71) Applicant: 4M CO., LTD., Naju-si, Jeollanam-do (KR)

(72) Inventor: Jae Il Sim, Jeollanam-do (KR)

(73) Assignee: 4M CO., LTD., Naju-si, Jeollanam-do (KR)

( * ) Notice: Subject to any disclaimer, the term of this patent is extended or adjusted under 35 U.S.C. 154(b) by 0 days.

(21) Appl. No.: 15/578,046

(22) PCT Filed: Nov. 9, 2017

(86) PCT No.: PCT/KR2017/012661
§ 371 (c)(1),
(2) Date: Nov. 29, 2017

(30) Foreign Application Priority Data

Nov. 8, 2017 (KR) ..... 10-2017-0148040

(51) Int. Cl.
*E04G 23/02* (2006.01)
*E04C 5/06* (2006.01)
*E04C 3/34* (2006.01)

(52) U.S. Cl.
CPC ..... *E04G 23/0218* (2013.01); *E04C 3/34* (2013.01); *E04C 5/0622* (2013.01)

(58) Field of Classification Search
CPC ..... E04G 23/0218; E04C 3/34; E04C 5/0622
USPC ..... 52/309.11, 309.12, 514.5, 649.3, 649.4, 52/649.8, 650.2
See application file for complete search history.

(56) References Cited

U.S. PATENT DOCUMENTS 1,014,711 A * 1/1912 Lindau ..... E04C 5/0618 52/649.4
3,298,152 A * 1/1967 Lockshaw ..... B64C 1/08 52/309.11
4,597,239 A * 7/1986 Matz ..... E21D 11/18 52/644
4,611,450 A * 9/1986 Chen ..... E04C 2/22 428/222
4,744,190 A * 5/1988 Couwenbergs ..... E04C 5/064 52/649.8
5,119,614 A * 6/1992 Rex ..... E04C 5/0604 52/649.3
6,185,890 B1 * 2/2001 Ritter ..... E04C 2/044 52/251

(Continued)

FOREIGN PATENT DOCUMENTS

JP 2011-236618 A 11/2011
JP 2016-089610 A 5/2016

(Continued)

OTHER PUBLICATIONS

International Search Report of PCT/KR2017/012661 dated Jul. 16, 2018.

*Primary Examiner* — Brian E Glessner
*Assistant Examiner* — Adam G Barlow
(74) *Attorney, Agent, or Firm* — Rabin & Berdo, P.C.

(57) ABSTRACT

Disclosed is a column reinforcing structure using V-shaped tie bars, in which V-shaped tie bars and reinforcing tie bars are used together in a pre-assembled reinforcement when reinforcing an existing column by concrete jacketing such that it is possible to effectively confine the concrete while preventing buckling of main reinforcing bars without installing cross ties and construction can be carried out very quickly and simply.

5 Claims, 6 Drawing Sheets

(56) References Cited

U.S. PATENT DOCUMENTS

| | | | | |
|---|---|---|---|---|
| 8,713,887 | B2 * | 5/2014 | Williams | E04C 5/0618 264/31 |
| 9,890,546 | B2 * | 2/2018 | Ehsani | E04G 23/0218 |
| 9,915,068 | B2 * | 3/2018 | Kim | E04C 3/34 |
| 2001/0010140 | A1 * | 8/2001 | Ritter | E04C 2/044 52/649.1 |
| 2003/0167715 | A1 * | 9/2003 | Messenger | E04C 2/044 52/309.12 |
| 2004/0154263 | A1 * | 8/2004 | Li | E04C 3/34 52/831 |
| 2009/0165404 | A1 * | 7/2009 | Choi | E04C 3/34 52/167.1 |
| 2016/0251856 | A1 | 9/2016 | Kim | |

FOREIGN PATENT DOCUMENTS

| | | | |
|---|---|---|---|
| KR | 10-2014-0004043 | A | 1/2014 |
| KR | 10-2015-0051434 | A | 5/2015 |
| KR | 10-1568016 | B1 | 11/2015 |
| KR | 10-1582342 | B1 | 1/2016 |

* cited by examiner (a)

(b)

COLUMN REINFORCING STRUCTURE USING V-SHAPED TIE BARS

STATEMENT REGARDING SPONSORED RESEARCH

This research was supported by a grant from Infrastructure and Transportation Tech Business Support Program funded by Ministry of Land, Infrastructure and Transport of Korean Government.

TECHNICAL FIELD

The present invention relates to a column reinforcing structure using V-shaped tie bars, in which V-shaped tie bars and reinforcing tie bars are used together in a pre-assembled reinforcement when reinforcing an existing column by concrete jacketing such that it is possible to effectively confine concrete while preventing buckling of main reinforcing bars without installing cross ties and construction can be carried out very quickly and simply.

BACKGROUND ART

In order to reinforce columns due to the increase of loads caused by the extension of a structure or strengthen a structure, to which no seismic design is applied, there is a method of reinforcing the outside of the column by means of steel jacketing, concrete jacketing or the like (Korean Patent No. 10-1568016 etc.).

In the steel jacketing method, an outer circumferential surface of an existing column formed of concrete is enclosed and fixed by a plurality of steel sheets by using fastening members or the like.

However, the steel jacketing method has a problem that since the steel sheet is vulnerable to fire or corrosion, the steel sheet needs to have additional fireproofing and rustproofing treatments. In addition, a separate structure is required to ensure the integrity between the steel sheet and the concrete.

Meanwhile, in the concrete jacketing method, an existing column is reinforced by increasing the cross-sectional area of the column by arranging reinforcing bars on the outside of the existing column, installing forms, and then pouring concrete.

The concrete jacketing method has advantages in that, unlike the steel jacketing method, there is no need for additional fireproofing and rustproofing treatments, it is also advantageous in ensuring the integrity with the existing concrete column, and the like.

However, it is difficult to prevent buckling of column main reinforcing bars due to the interference of the existing column or directly apply cross ties, which are installed for concrete confinement or the like. Accordingly, it is necessary to form a jacketed column in such a manner that a hole is punctured at a predetermined depth in the existing column and an anchor is installed so as to fix the cross tie, thereby decreasing constructability. In addition, there is a disadvantage in that it takes a long construction time due to a lot of field work.

DISCLOSURE

Technical Problem

Accordingly, the present invention has been made in an effort to solve the above-mentioned problems and disadvantages occurring in the prior arts, and the present invention aims to provide a column reinforcing structure using V-shaped tie bars, in which it is possible to effectively confine concrete and prevent buckling of main reinforcing bars without installing cross ties, when reinforcing an existing column by concrete jacketing.

The present invention is to provide a column reinforcing structure using V-shaped tie bars, in which it is possible to minimize the construction work in the field and shorten the construction time, thereby facilitating construction.

Technical Solution

The present invention according to a preferred embodiment relates to a column reinforcing structure, in which pre-assembled reinforcements are installed on the outside of an existing column formed of reinforced concrete and concrete is laid on site, and provides a column reinforcing structure using V-shaped tie bars characterized in that each of the pre-assembled reinforcements comprises: a plurality of main reinforcing bars provided to be spaced apart from each other in the lateral direction; a plurality of V-shaped tie bars, each of which is bent in the shape of a "V" and has one pair of legs parts such that the inside of the bent part comes into contact with the outside of the main reinforcing bar and the leg parts face the surface of the existing column; and reinforcing tie bars joined to the outside of the plurality of main reinforcing bars in the lateral direction.

According to another preferred embodiment of the present invention, there is provided a column reinforcing structure using V-shaped tie bars, in which the pre-assembled reinforcements are provided separately for each surface of the existing column, and an anchoring tie bar is provided on the outside of the corners of neighboring ones of the pre-assembled reinforcements.

According to another preferred embodiment of the present invention, there is provided a column reinforcing structure using V-shaped tie bars, in which the upper ends of the main reinforcing bar of the pre-assembled reinforcement protrude through an upper slab to a predetermined length above the slab.

According to another preferred embodiment of the present invention, there is provided a column reinforcing structure using V-shaped tie bars, in which the upper end of the main reinforcing bar is coupled by a coupler to the lower end of the main reinforcing bar of the pre-assembled reinforcement installed in an upper layer.

According to another preferred embodiment of the present invention, there is provided a column reinforcing structure using V-shaped tie bars, in which the end portions of the leg parts of the V-shaped tie bar are coupled to anchor plates or have enlargement parts formed with an enlarged diameter of the end portions of the leg parts.

Advantageous Effects

According to the present invention, when reinforcing an existing column by concrete jacketing, it is possible to effectively confine the concrete and prevent buckling of main reinforcing bars without installing cross ties since the V-shaped tie bars and the reinforcing tie bars are used together in the pre-assembled reinforcements.

In addition, the pre-assembled reinforcements, which are pre-assembled in advance, are set around the existing column and then the concrete is laid on site such that the construction is very fast and simple, thereby minimizing field construction and shortening the construction time.

BEST MODE FOR CARRYING OUT THE INVENTION

In order to achieve the above-mentioned objectives of the present invention, a column reinforcing structure using V-shaped tie bars according to the present invention relates to a column reinforcing structure, in which pre-assembled reinforcements are installed on the outside of an existing column formed of reinforced concrete and concrete is laid on site, and the pre-assembled reinforcement includes: a plurality of main reinforcing bars provided to be spaced apart from each other in the lateral direction; a plurality of V-shaped tie bars, each of which is bent in the shape of a "V" and has one pair of legs parts such that the inside of the bent part comes into contact with the outside of the main reinforcing bar and the leg parts face the surface of the existing column; and reinforcing tie bars joined to the outside of the plurality of main reinforcing bars in the lateral direction.

MODE FOR INVENTION

Hereinafter, the present invention will be described in detail in accordance with preferred embodiments thereof with reference to the accompanying drawings.

Figure 1:
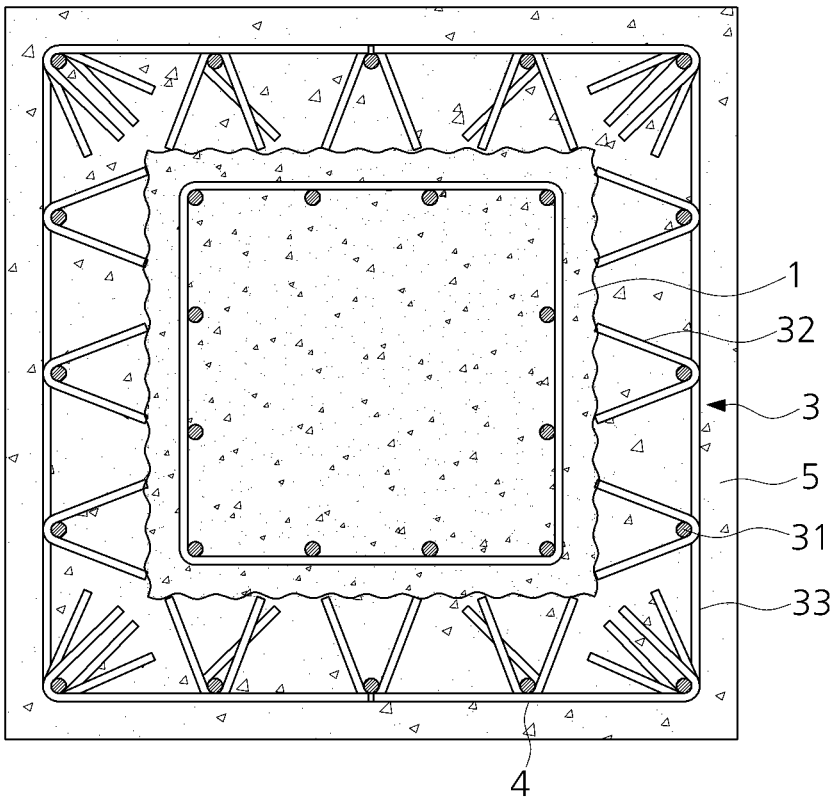
FIG. 1 is a plan sectional view showing an embodiment of a column reinforcing structure using V-shaped tie bars according to the present invention.
Figure 2:
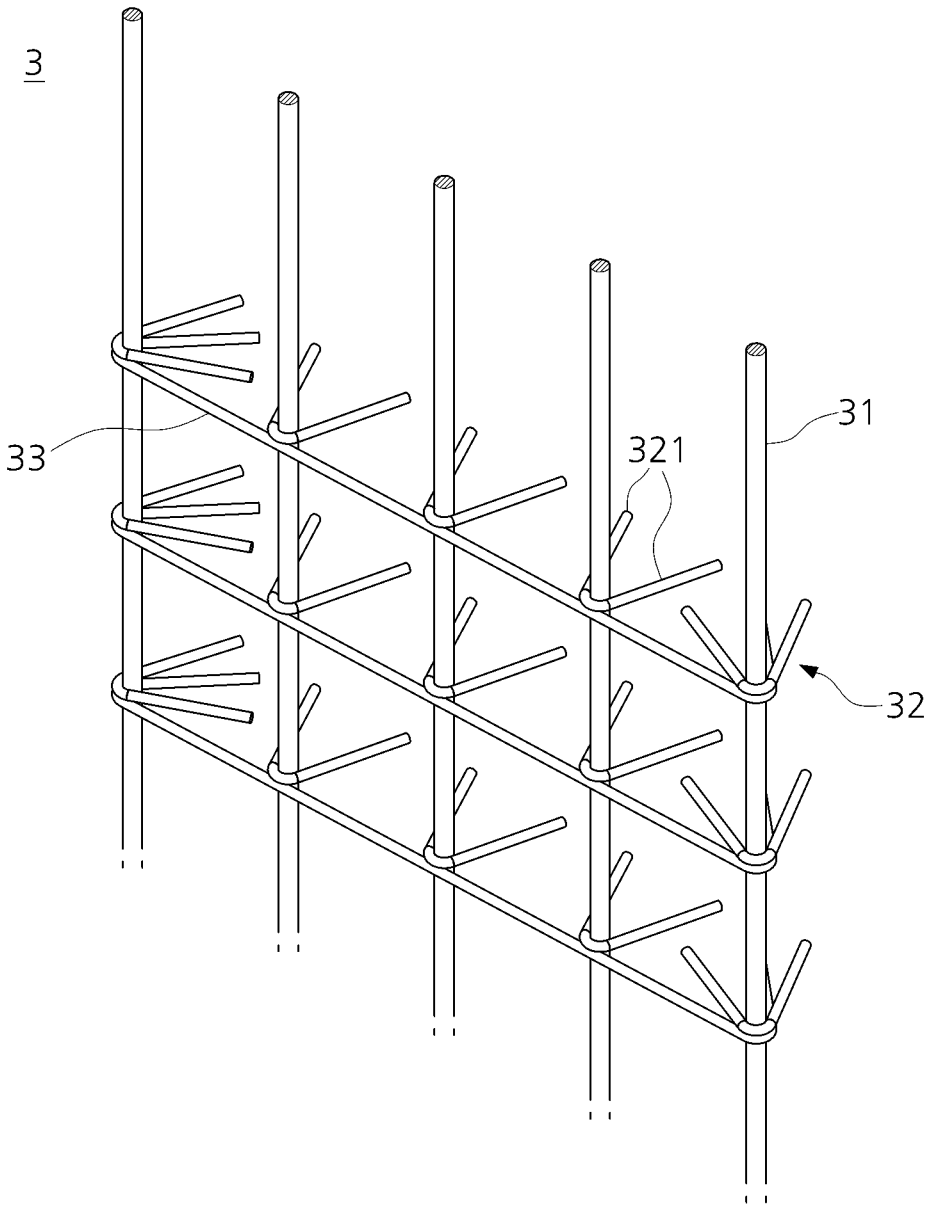
FIG. 2 is a perspective view of a pre-assembled reinforcement.

FIG. 1 is a plan sectional view showing an embodiment of a column reinforcing structure using V-shaped tie bars according to the present invention, and FIG. 2 is a perspective view of a pre-assembled reinforcement.

As shown in FIG. 1, FIG. 2 and the like, a column reinforcing structure using V-shaped tie bars according to the present invention relates to a column reinforcing structure, in which pre-assembled reinforcements 3 are installed on the outside of an existing column 1 formed of reinforced concrete and concrete 5 is laid on site, and is characterized in that each of the pre-assembled reinforcements 3 includes: a plurality of main reinforcing bars 31 provided to be spaced apart from each other in the lateral direction; a plurality of V-shaped tie bars 32, each of which is bent in the shape of a "V" and has one pair of legs parts 321 such that the inside of the bent part comes into contact with the outside of the main reinforcing bar 31 and the leg parts 321 face the surface of the existing column 1; and reinforcing tie bars 33 joined to the outside of the plurality of main reinforcing bars 31 in the lateral direction.

The present invention relates to the column reinforcing structure using V-shaped tie bars, in which the pre-assembled reinforcements 3 are installed on the outside of the existing column 1 formed of reinforced concrete and the concrete 5 is laid on site, thereby reinforcing the column.

That is, the present invention is to reinforce the existing column 1 by concrete jacketing in such a manner that the pre-assembled reinforcements 3, which are pre-assembled in advance, are positioned on the outside of the existing column 1, a form is installed at a predetermined position, and then the concrete 5 is laid on site.

The pre-assembled reinforcement 3 includes main reinforcing bars 31, V-shaped tie bars 32, and a reinforcing tie bar 33.

The main reinforcing bar 31 is a vertical reinforcing bar positioned outside the existing column 1, wherein a plurality of main reinforcing bars 3 are provided to be spaced apart from each other in the lateral direction.

The main reinforcing bar 31 shares the compressive force with the concrete 5 and bears the tensile stress caused by bending.

The V-shaped tie bar 32 is bent in the shape of a "V" and has one pair of leg parts 321, wherein the V-shaped tie bar 32 may be formed by bending a tie bar.

The V-shaped tie bar 32 is coupled to the main reinforcing bar 31 such that the inside of the bent part comes into close contact with the outside of the main reinforcing bar 31 and the leg parts 321 face the surface of the existing column 1.

The V-shaped tie bar 32 is to replace the cross tie, which is difficult to install at the time of reinforcement by column jacketing, wherein the V-shaped tie bar 32 can reduce the amount of steel bars compared to the cross tie and the V-shaped tie bar 32 is not only economical but also has excellent energy absorption capability, so that the V-shaped tie bar 32 can be effectively applied to seismic design.

The V-shaped tie bar 32 is coupled to the main reinforcing bars 31 in a direction perpendicular to the main reinforcing bar 31 and embedded in the concrete 5, so that the V-shaped tie bar 32 can serve as a shear connection member.

The V-shaped tie bar 32 also acts as a spacer so as to keep the main reinforcing bars 31 of the pre-assembled reinforcement 3 at a predetermined interval from the outer surface of the existing column 1.

The reinforcing tie bar 33 is coupled to the outside of the plurality of main reinforcing bar 31 in the lateral direction.

The reinforcing tie bar 33 acts as a tie bar of the reinforced column so as to prevent buckling of the main reinforcing bars 31. In addition, when the concrete 5 is broken, the reinforcing tie bar 33 confines the lateral spreading so as to increase the ductility of the concrete 5 and fixes the plurality of the main reinforcing bars 31 so as to constitute a single integrated pre-assembled reinforcement 3.

As described above, since the V-shaped tie bar 32 and the reinforcing tie bar 33 are used together, it is possible to prevent the buckling of the main reinforcing bar 31 and effectively confine the concrete 5 without installing the cross time when reinforcing the existing column by the concrete 5 jacketing.

In addition, the pre-assembled reinforcements 3, which are pre-assembled in advance, are built around the existing column 1 and then the concrete 5 is simply laid and cured such that the construction is very fast and simple. Therefore, the field construction is minimized and thus the shortening the construction time can be expected.

Figure 3:
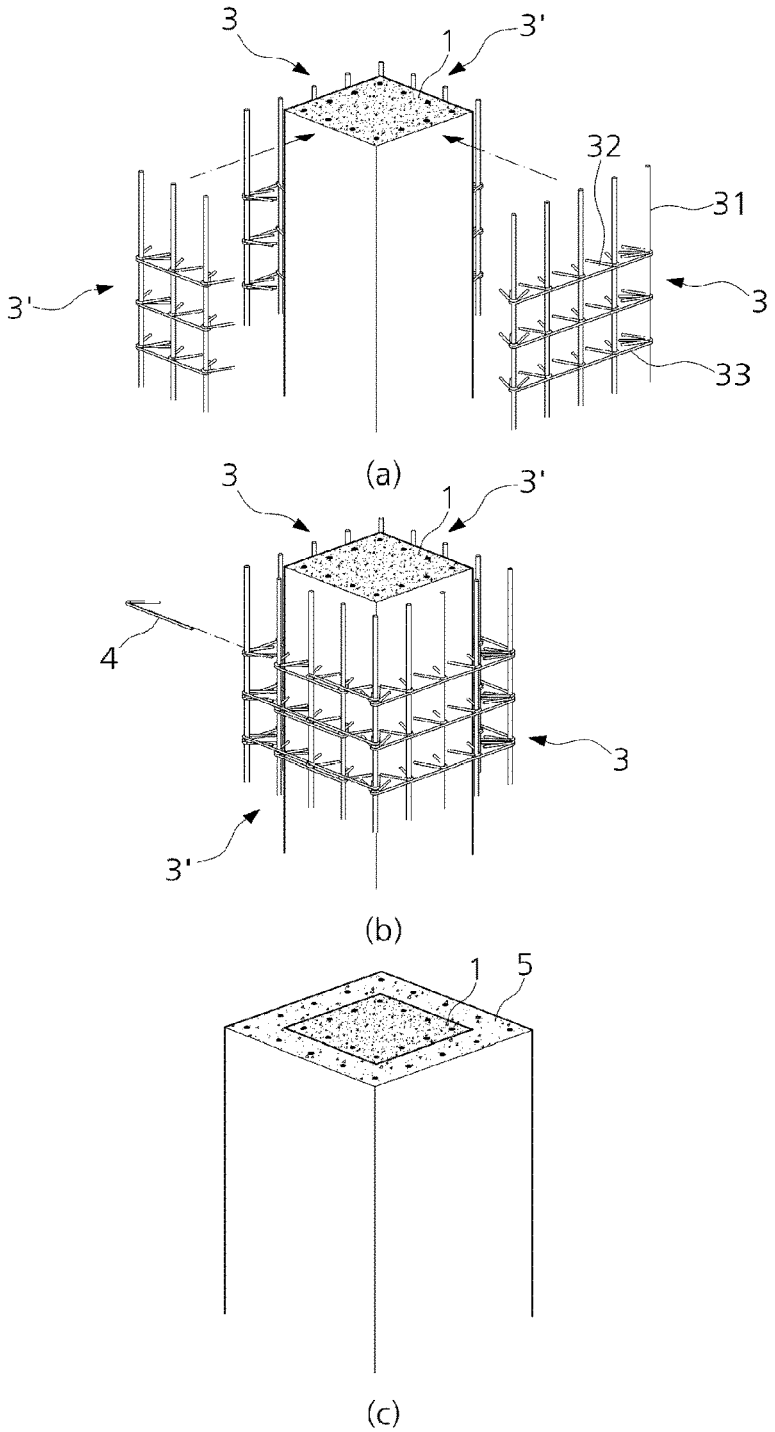
FIG. 3 is a perspective view showing the construction sequence of the column reinforcing structure using V-shaped tie bars according to the present invention.
Figure 4:
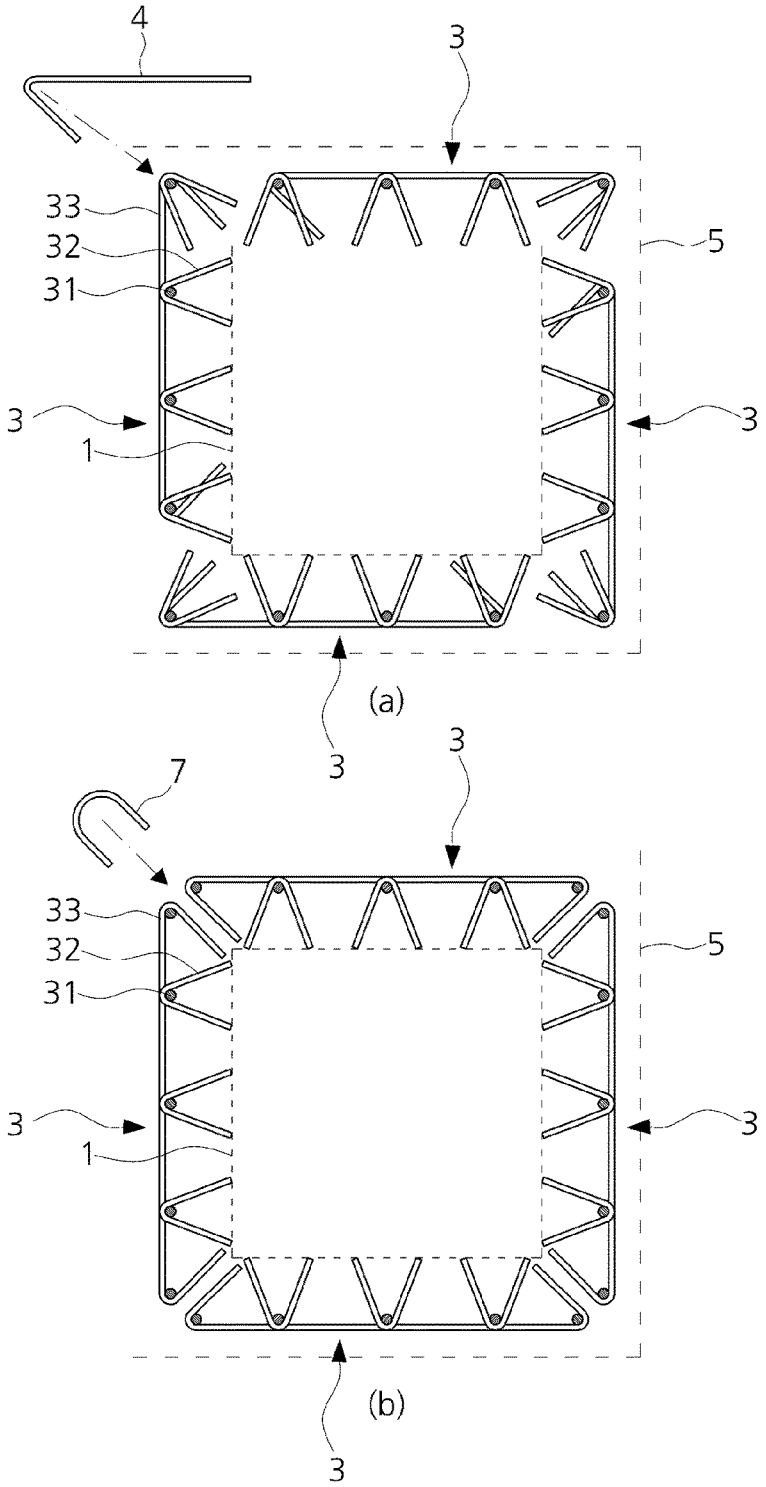
FIG. 4 is a plan sectional view showing another embodiment of the column reinforcing structure using V-shaped tie bars according to the present invention.

FIG. 3 is a perspective view showing the construction sequence of the column reinforcing structure using V-shaped tie bars according to the present invention, and FIG. 4 is a plan sectional view showing another embodiment of the column reinforcing structure using V-shaped tie bars according to the present invention.

The pre-assembled reinforcements 3 are provided separately for each surface of the existing column 1, and an anchoring tie bar 4 is provided on the outside of the corners of neighboring pre-assembled reinforcements 3, 3'.

It is preferable that the pre-assembled reinforcements 3 are separately formed for each surface of the existing column 1 for the ease of field assembly.

In this case, the reinforcing tie bars 33 of the neighboring pre-assembled reinforcement 3, 3' are discontinuous each other, so that the anchoring tie bar 4 can be coupled to and fixed at the corner portion of the column so as to enable the neighboring reinforcing tie bars 33 to be continued.

As described above, since the reinforcing tie bars 33 of each of the column surfaces are connected to each other by the coupling of the anchoring tie bars 4, the concrete 5 inside the reinforcing tie bars 33 can be confined.

The anchoring tie bar 4 is installed in the field and it is preferable that the end portions of the anchoring tie bar 4 are bent at 135° so as to be hung on the main reinforcing bars 31 disposed at the corners.

FIG. 3*a* to FIG. 3*c* show the construction sequence for the column reinforcing structure using V-shaped tie bars according to the present invention, in which the anchoring tie bar 4 is provided.

First, as shown in FIG. 3*a*, the pre-assembled reinforcements 3 are installed on each surface of the existing column 1. In addition, as shown in FIG. 3*b*, the main reinforcing bars 31 of the neighboring pre-assembled reinforcements 3, 3' are joined together with the anchoring tie bars 4. Then, after installing the forms, as shown in FIG. 3*c*, the concrete 5 is laid and cured outside the existing column 1, completing the jacketed column.

In order to ensure the integration between the newly laid concrete 5 and the concrete of the existing column 1, it is preferable that the concrete surfaces of the existing column 1 are subject to chipping so as to treat the rough surfaces thereof before the installation of the pre-assembled reinforcements 3.

The width of the pre-assembled reinforcement 3 can be determined according to the interval and number of the main reinforcing bars 31.

Therefore, as shown in FIG. 1 and FIG. 3, the pre-assembled reinforcements 3, which are installed on two opposed surfaces of the column in one direction of the column, can be formed of a wide width so as to include the main reinforcing bars 31 disposed at the corner portions thereof, while the pre-assembled reinforcements 3', which are installed on two opposed surfaces in the other direction that is orthogonal to the one direction of the column, can be formed of a narrow width.

Alternatively, as shown in FIG. 4, it is also possible to form the pre-assembled reinforcements 3 for each surface of the column with the same standard. In this case, since each one of the pre-assembled reinforcements 3 can be manufactured with the same standard, it is easy to manufacture and construct.

FIG. 4*a* shows an arrangement, in which each of the pre-assembled reinforcements 3 are arranged to include the main reinforcing bar 31 only at one corner. In this case, the anchoring tie bar 4 having an end portion folded at 135° is joined to the end portions of the neighboring pre-assembled reinforcements 3 so as to form a closed tie bar.

FIG. 4*b* shows another arrangement, in which each of the pre-assembled reinforcements 3 are arranged to include two main reinforcing bars 31 at both corners. In this case, U-shaped reinforcing bars 7 can be joined to the end portions of the neighboring pre-assembled reinforcements 3 so as to encompass the main reinforcing bars 31 at the end portions.

Figure 5:
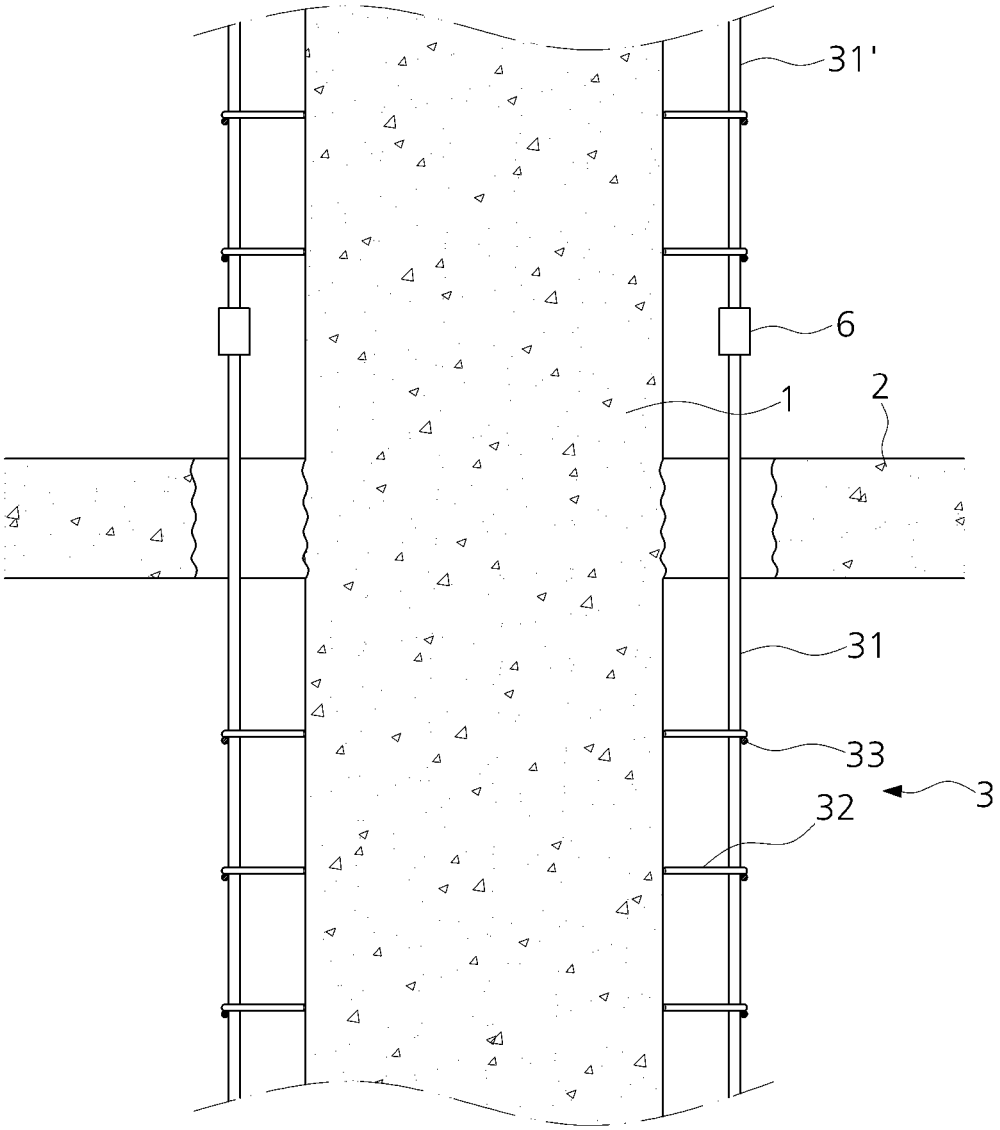
FIG. 5 is a side cross-sectional view showing the coupling relation of upper and lower pre-assembled reinforcements.

FIG. 5 is a side cross-sectional view showing the coupling relation of upper and lower pre-assembled reinforcements.

As shown in FIG. 5, the upper ends of the main reinforcing bar 31 of the pre-assembled reinforcement 3 can be formed to protrude through an upper slab 2 to a predetermined length above the slab 2.

In order to improve the seismic performance of columns in multi-storied buildings, the main reinforcing bars 31 of the pre-assembled reinforcements 3 installed in upper and lower layers should be continued when reinforcing the columns of the multi-storied buildings.

To this end, the slab 2 is removed around the existing column 1 and the upper portions of the main reinforcing bars 31 of the lower pre-assembled reinforcement 3 are projected to the upper portion of the slab 2 and joined to the main reinforcing bars 31 of the upper pre-assembled reinforcement 3.

Herein, the upper end of the main reinforcing bars 31 of the pre-assembled reinforcement 3 that is installed in the lower layer can be coupled by a coupler 6 to the lower end of the main reinforcing bars 31 of the pre-assembled reinforcement 3 that is installed in the upper layer.

The main reinforcing bars 31 of the upper and lower pre-assembled reinforcements 3 can be joined by overlapping each other. However, in some cases, when the main reinforcing bars 31 of the pre-assembled reinforcement 3 are inserted into the upper portion of the slab 2, it may be difficult to install the main reinforcing bars 31 because of the interference with the slab 2 in the case where the length of the main reinforcing bars 31 is long or the like.

Therefore, the upper ends of the main reinforcing bars 31 installed in the lower layer may be coupled by the couplers 6 to the main reinforcing bars 31 installed at the upper layer so as to minimize the length of the main reinforcing bars 31.

In addition, when constructing the pre-assembled reinforcement 3 of the upper layer, the pre-assembled reinforcement 3 of the upper layer can be firmly fixed to the main reinforcing bars 31 that form the pre-assembled reinforcement 3 of the lower layer.

Figure 6:
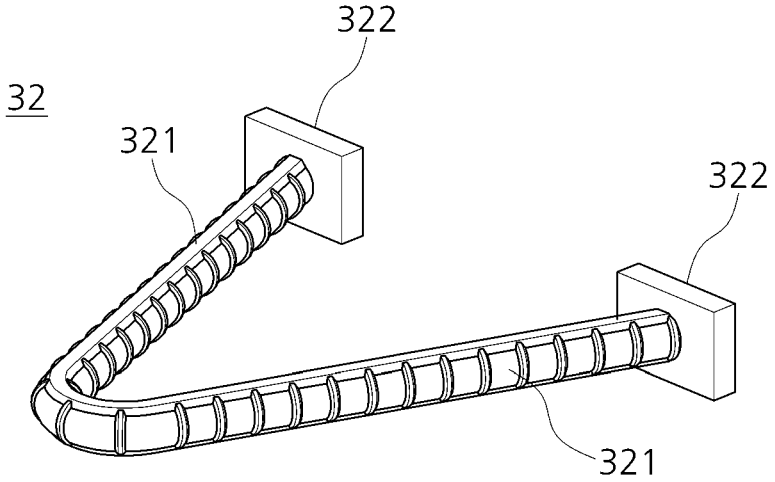
FIG. 6 is a perspective view illustrating various embodiments of a V-shaped tie bar.
Figure 6:
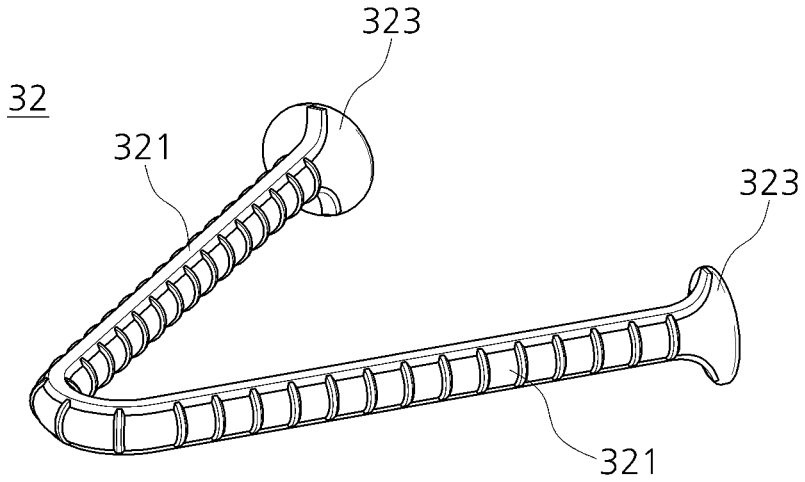

FIG. 6 is a perspective view illustrating various embodiments of the V-shaped tie bar.

As shown in FIG. 6*a* and FIG. 6*b*, an anchor plate 322 may be coupled to each end portion of the leg parts 321 of the V-shaped tie bar 32, or an enlargement part 323 may be formed on each end portion of the leg parts 321 by enlarging the diameter of the end portion.

When an anchoring length is not sufficient with the leg parts 321 of the V-shaped tie bar 32, it is possible to join the anchor plate 322 to the end portion of the leg part 321 as shown in FIG. 6*a*, or form the enlargement part 323 by enlarging the cross section of the end portion of the leg part 321 as shown in FIG. 6*b*.

As a result, the anchoring force of the leg parts 321 can be increased and the thickness of the column jacketing can be minimized, facilitating economical design.

The anchor plate 322 can be welded to the end portion of the leg part 321. Besides, it is also possible to form a coupling hole (not shown) in the center of the anchor plate 322 and form a thread on the end portion of the leg part 321 such that the anchor plate 322 and the leg part 321 can be screw-coupled to each other.

The enlargement part 323 can be formed by hot upset forming of the leg part 321.

INDUSTRIAL APPLICABILITY

When reinforcing the existing column by concrete jacketing, The column reinforcing structure using V-shaped tie bars of the present invention is industrially applicable in that the V-shaped tie bars and the reinforcing tie bars are used together for the pre-assembled reinforcements instead of anchoring cross ties to the existing column, such that it is possible to effectively confine the concrete while preventing buckling of the main reinforcing bars, thereby facilitating fast and simple construction.

What is claimed is:

1. A column reinforcing structure, comprising:

a column formed of reinforced concrete;

a pre-assembled reinforcement installed such that the pre-assembled reinforcement surrounds an outer surface of the column; and concrete covering the pre-assembled reinforcement such that the pre-assembled reinforcement is embedded in the concrete, wherein the pre-assembled reinforcement includes:

a plurality of main reinforcing bars extending in a longitudinal direction and spaced apart from each other;

a plurality of V-shaped tie bars, each of which is bent in a shape of "V" with a bent part and one pair of legs parts such that an inside of the bent part comes into contact with one of the main reinforcing bars and ends of the leg parts face the outer surface of the column; and reinforcing tie bars coupled with the plurality of main reinforcing bars in a lateral direction.

2. The column reinforcing structure according to claim 1, wherein the pre-assembled reinforcement is provided on each surface of the column, and an anchoring tie bar is provided between neighboring pre-assembled reinforcements.

3. The column reinforcing structure according to claim 1, wherein upper ends of the main reinforcing bars of the pre-assembled reinforcement protrude through an upper slab to a predetermined length above the slab.

4. The column reinforcing structure according to claim 3, wherein each of the upper ends of the main reinforcing bars is coupled by a coupler (6) to corresponding one of lower ends of the main reinforcing bars of the pre-assembled reinforcement (3) installed in an upper layer.

5. The column reinforcing structure according to claim 1, wherein the ends of the leg parts of the V-shaped tie bar are coupled to anchor plates or have enlargement parts formed with an enlarged diameter of the ends of the leg parts.

* * * * *